US006481390B1

(12) United States Patent
Robb

(10) Patent No.: US 6,481,390 B1
(45) Date of Patent: Nov. 19, 2002

(54) WATER PUMP WITH ELECTRONICALLY CONTROLLED VISCOUS COUPLING DRIVE

(75) Inventor: Neil E Robb, Jackson, MI (US)

(73) Assignee: Borg Warner, Inc., Troy, MI (US)

( * ) Notice: Subject to any disclaimer, the term of this patent is extended or adjusted under 35 U.S.C. 154(b) by 0 days.

(21) Appl. No.: 09/884,909

(22) Filed: Jun. 19, 2001

(51) Int. Cl.[7] ..... F01P 5/10
(52) U.S. Cl. ..... 123/41.44
(58) Field of Search ..... 123/41.44, 198 C

(56) References Cited

U.S. PATENT DOCUMENTS 4,920,929 A * 5/1990 Bishop ..... 123/41.49
6,021,747 A * 2/2000 Gee et al. ..... 123/41.12

* cited by examiner

*Primary Examiner*—Gene Mancene
*Assistant Examiner*—Hyder Ali
(74) *Attorney, Agent, or Firm*—Artz & Artz, P.C.; Greg Dziegielewski

(57) ABSTRACT

An electronically-controlled viscous coupling is coupled to a water pump to control the coolant flow rate of engine coolant to an engine to maximize fuel economy and minimize emissions while preventing pump cavitation and possible water pump damage. The viscous coupling controls the rotational speed of a water pump shaft that is used for moving engine coolant through a cooling system as a function of engine speed and engine temperature. The viscous coupling has a stationary electrical coil that, when excited by electrical current, closes valve members which prevent the viscous fluid from entering the working chamber, thereby preventing the creation of torque to drive the water pump shaft.

13 Claims, 2 Drawing Sheets

WATER PUMP WITH ELECTRONICALLY CONTROLLED VISCOUS COUPLING DRIVE

TECHNICAL FIELD

The invention relates generally to water pumps and more specifically to water pumps having an electrically controlled viscous coupling drive.

BACKGROUND ART

Water pumps are typically used on vehicles today to provide heat transfer means for an engine during operation. The engine crankshaft typically drives water pumps at a fixed ratio. Thus, as the engine idle speed is reduced, as is the trend in vehicles today to reduce emissions, the water pump speed is correspondingly reduced. This reduction in water pump speed results in a reduction in the coolant flow through the cooling system which can result in poor heater output for the interior of the vehicle when needed in cold weather and also can result in poor coolant flow for engine cooling during hot weather.

Increasing the water pump speed by increasing the drive ratio from the crankshaft will increase the coolant flow at engine idle speeds, but it may result in overspeeding the pump at higher engine speeds which may produce pump cavitation and reduced water pump bearing life. Pump cavitation can result in pump damage and a reduction in cooling system performance.

The current state of the art is to add an auxiliary water pump, typically electrically driven, to provide additional coolant flow at low engine idle speeds. Another approach is to use moveable vanes in the inlet of the water pump to throttle the coolant flow at higher engine speeds.

It is thus an object of the present invention to provide good coolant flow at low engine idle speeds while avoiding pump cavitation at higher engine speeds ;without the need for an auxiliary water pump or moveable vanes. It is another object of the present invention to control the speed of the water pump for improving emissions and fuel economy.

SUMMARY OF THE INVENTION

The above and other objects of the invention are met by the present invention that is an improvement over known water pumps.

The present invention provides an electrically controlled viscous coupling between a pulley and a water pump shaft. Varying the amount of viscous fluid in the small clearance, or working chamber, between the pulley and the clutch controls the speed of the water pump. This viscous fluid creates shear that produces torque that is transmitted to the clutch that is connected to the water pump shaft. As the torque changes, the speed of the water pump changes. A valve that reacts to magnetic flux from a stationary coil mounted on the water pump housing controls the amount of fluid in the chamber.

The electronically controlled viscous coupling thus provides good coolant flow at low engine idle speeds while avoiding pump cavitation at higher engine speeds without the need for an auxiliary water pump or moveable vanes. This also improves fuel economy and emissions by maintaining the engine within an acceptable temperature range regardless of engine speed.

Other features, benefits and advantages of the present invention will become apparent from the following description of the invention, when viewed in accordance with the attached drawings and appended claims.

BEST MODE(S) FOR CARRYING OUT THE INVENTION

Figure 1:
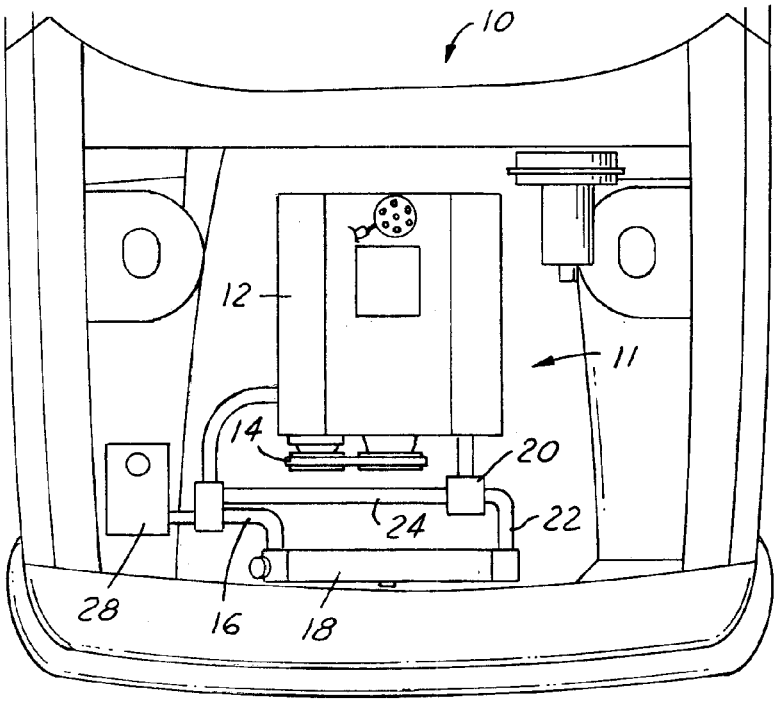
(PRIOR ART) FIG. 1
FIG. 1 illustrates a cooling system having a water pump according to the prior art.

Referring now to FIG. 1, a typical cooling system 11 for an internal combustion engine 12 according to the prior art uses a water pump 14 to control engine temperature of a vehicle 10. When an internal combustion engine 12 is started, coolant enters the water pump 14 through a branch duct 16 from a radiator 18. Coolant is then pumped out of the water pump 14 and into the cooling passages (not shown) of the engine 12. The coolant flows through the engine 12 to the thermostatic flow control valve 20. Coolant will then flow back to the radiator 18 through a supply duct 22 or be bypassed through a bypass duct 24 depending upon the engine coolant temperature as determined by thermostatic control valve 20. When the engine 12 is cool, the thermostatic flow control valve 20 directs the coolant through the bypass duct 24. If the engine 12 is warm, the thermostatic flow control valve 20 directs the coolant through the supply duct 22 to the radiator 18, where the coolant is cooled. A coolant overflow area 28 is typically coupled to the branch duct 16. It will be understood that, as used herein, the term "coolant" is used interchangeably as engine coolant, such as antifreeze, or water.

One problem with the currently available engine driven water pumps 14 is that the speed of rotation of the water pump 14 is, at all times, tied to the speed of the engine 12. As such, during engine idle modes, when the speed of the engine 12 is low, the flow rate of water through the system 11 is correspondingly low. As engine idle speeds are lowered further for emissions purposes, this flow rate will correspondingly decrease. Further, as the speed of the engine 12 increases, the rotational speed of the water pump 14 correspondingly increases. At these higher rates of rotational speed, water pump cavitation may occur, wherein the amount of coolant that is capable of being pumped through the water pump 14 cannot keep up with the rotational speed of the impellers (not shown) within the water pump 14. This creates a vacuum within the water pump 14 and may lead to pump damage. Finally, during normal operating conditions, this higher rotational speed typically is not needed to maintain the engine 12 within acceptable temperature ranges, thus the excess rotational speed is not necessary for optimal operation of the engine 12 and coolant system 11. Further, the excess torque created has an adverse effect on fuel economy and emissions.

To alleviate these concerns, the present invention controls the water pump speed by coupling an electronically controlled viscous coupling to the water pump of the cooling system 11. A preferred embodiment of the present invention having an electronically controlled viscous coupling 50 is depicted below in FIGS. 2, 3 and 4.

Figure 4:
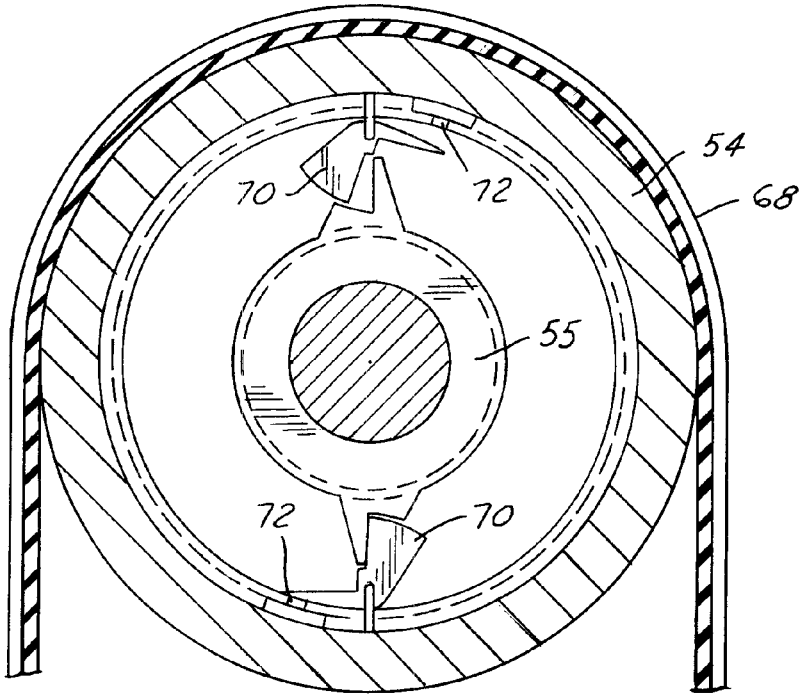
FIG. 4 is a section view of FIG. 3 taken along line 4—4.
Figure 3:
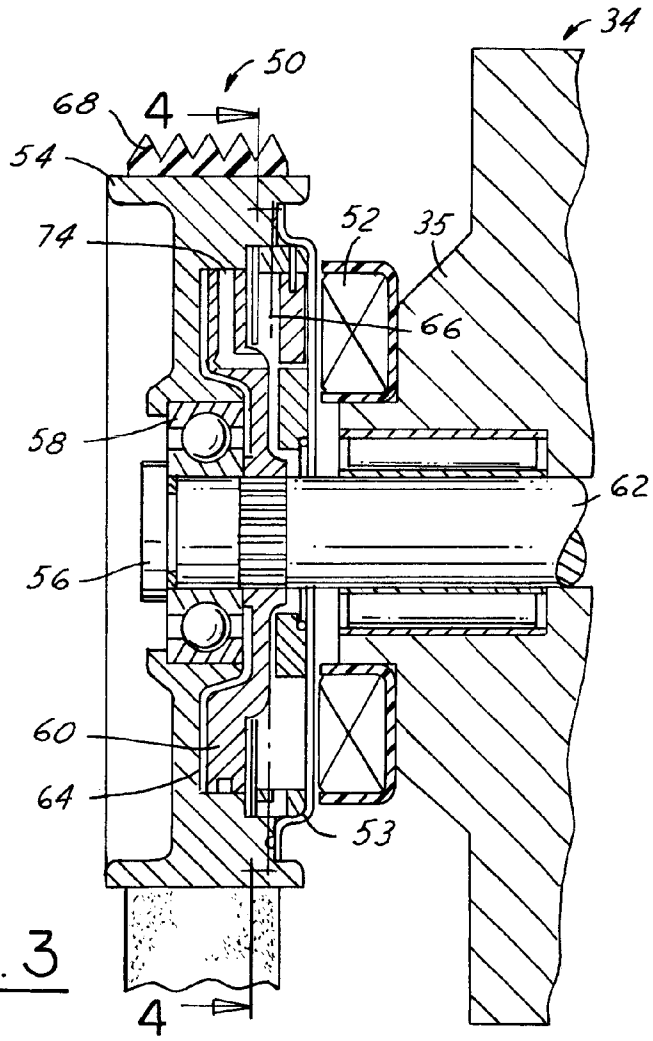
FIG. 3 is a section view of FIG. 2 taken along line 3—3.
Figure 2:
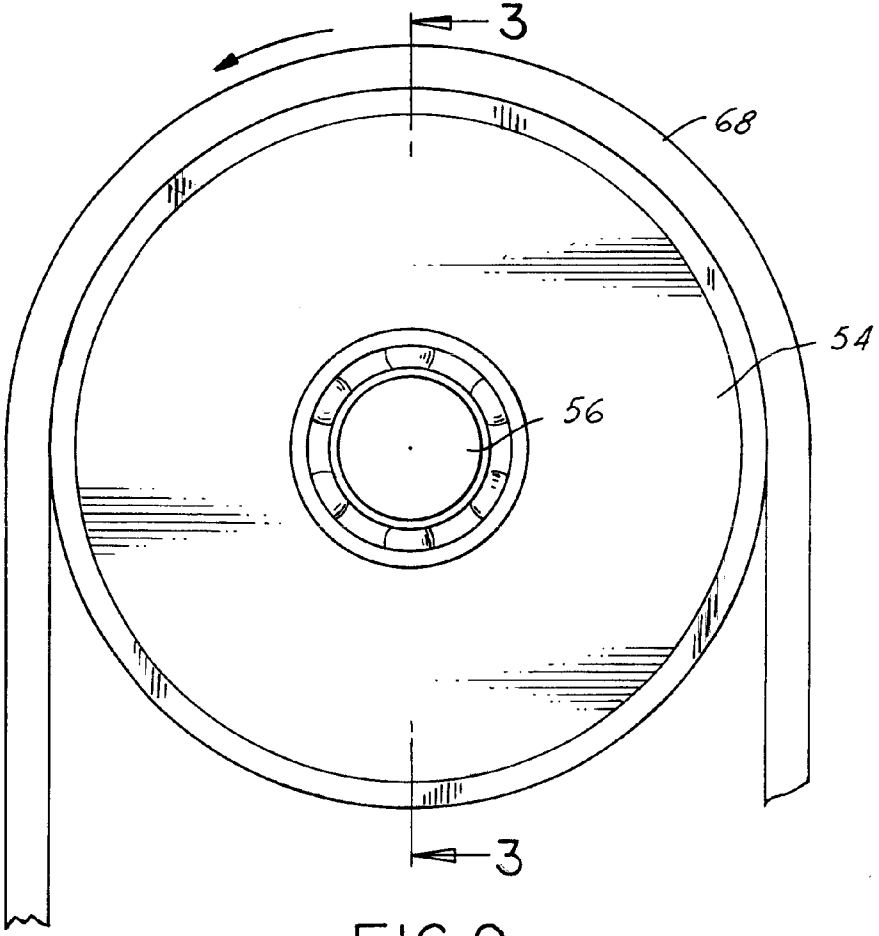
FIG. 2 illustrates a viscous water pump drive coupled to a water pump according to a preferred embodiment of the present invention.

Referring now to FIG. 3, a stationary coil 52 of the electronically controlled viscous coupling 50 is mounted to an outer housing 35 of a water pump 34. The coil 52 is also coupled to the body 53 of the coupling 50, which is coupled to a flux ring 55. A pulley 54 is mounted to the clutch shaft 56 by a bearing 58. A clutch 60 is mounted on a water pump shaft 62 that extends into the water pump 34 and is coupled with a plurality of impellers (not shown). A working chamber 64 is defined between the pulley 54 and the clutch 60, while a reservoir 66 is contained on the opposite side of the clutch 60. As best seen in FIGS. 2, 3 and 4, the pulley 54 is driven by the belt 68 that is typically connected to the crankshaft of the engine 12.

Viscous fluid, typically a silicone-based fluid, is contained in the working chamber 64. The viscous fluid produces shear because of the speed differential between the pulley 54 and the clutch 60. The shear produces torque which is transmitted to the clutch 60 and in turn to the water pump shaft 62. By varying the amount of viscous fluid between the pulley 54 and clutch 60, the amount of torque transmittal will vary and thus will change the speed of the water pump 34. Fluid can escape back to the reservoir through channel 74.

As best shown on FIG. 4, the amount of fluid in the working chamber 64 is controlled by valves 70 that react to magnetic flux from the stationary coil 52 mounted on the water pump housing 35. The magnetic flux across the gaps is caused by electrical excitation of the stationary coil 52 which in turn cause the valves 70 to pivot and close fill ports 72. A pump on the clutch 60 moves the viscous fluid back to a reservoir 66 and out of the working area 64 of the viscous coupling 50.

If the valve 70 is closed, the viscous fluid remains in the reservoir 66 and out of the working area 64. As such, the pulley 54 will spin freely, while the clutch 60 will remain stationary or rotate at a preset slow speed to provide enough circulation to prevent hot spots from forming in the engine 12 and flow to the heater (not shown). When the clutch 60 is stationary, no torque is transmitted to the water pump shaft 62, and therefore the impellers coupled to the water pump shaft 62 will not rotate within the water pump 34. Thus, the cooling system 11 has little or no coolant flow rate when the valve 70 is in the closed position.

The excitation of the stationary coil 52 may be controlled in a wide variety of preferred ways. For example, in one preferred embodiment of the present invention, an electronic control unit (not shown) may be electronically coupled between the stationary coil 52 and a number of vehicle sensors (not shown) to control electrical excitation as a function of many different automotive input signals obtained from the vehicle sensors. A non-exhaustive list of potential input signals includes cylinder head temperature signals, fuel injection timing signals, and heater demand signals. In alternative embodiments, the electronic control unit may also be coupled to a cooling fan and coolant valve in addition to stationary coil 52 and vehicle sensors to further optimize fuel economy and emissions. Moreover, in other alternative embodiments, the control of electrical excitation of the stationary coil 52 may be controlled via a thermal switch coupled within an engine or cooling system component.

In the configuration shown in FIGS. 2–4, the viscous coupling 50 is failsafe. If the electrical power is turned off or fails in some manner, centrifugal force will cause the valve 70 to remain open and fluid will flow into the working chamber 64 between the pulley 54 and clutch 60. This is the invention in copending U.S. application Ser. No. 09/728,015, filed Dec. 1, 2000, the disclosure of which is herein incorporated by reference.

The present invention offers many advantages over currently available cooling systems 11. First, the water pump speed is controlled electronically to provide adequate coolant flow under various circumstances. When the engine 12 is first turned on, at a point where the engine temperature is measured by temperature sensors to be cool, the coupling 50 is maintained in an open position to allow engine coolant to flow through the cooling system 11 at a rate proportional to the amount of torque created based on the amount of viscous fluid in the working area 64 and engine speed. This allows the engine 12 to warm up as quickly as possible to its preferred engine temperature range, wherein fuel economy and emissions are idealized. As the engine 12 warms up to acceptable levels, as sensed by various engine temperature sensors, the amount of rotation of the water pump shaft 62, and correspondingly the amount of coolant flow through the cooling system 11, can be reduced by causing the valve 70 to move to a partially-closed position, thereby limiting the amount of viscous fluid entering the working area 64, which limits the amount of shear and torque available to rotate the water pump shaft 62, thereby limiting the amount of coolant flow through the cooling system 11. Finally, in conditions where low coolant flow is required by the cooling system 11, the coil 52 is excited with enough voltage to create enough magnetic flux to close the valve 70 completely. Thus, in all circumstances, the amount of torque necessary to maintain the cooling system 11 to provide idealized fuel economy and emissions at various engine speeds and temperatures can be quickly and continually adjusted by simply varying the electrical excitation of a stationary coil 52 in the coupling 50.

Second, the present invention prevents pump cavitation in the water pump 34 by coupling the rotation of the water pump shaft 62 to the electronically-controlled viscous coupling 50. As is described in copending U.S. application Ser. No. 09/728,015, filed Dec. 1, 2000, the rotational speed of the water pump shaft 62 is limited to a finite rotational rate by the shearing rate of viscous fluid contained in the working chamber 64, which produces the torque necessary to drive the clutch 60 and water pump shaft 62. This finite rotational rate is, at all times, less than the rotational rate necessary to create a vacuum within the water pump 34 that is necessary to cause pump cavitation.

Third, because the valve 70 is maintained in an open position absent electrical excitation of the stationary coil 52, the viscous coupling 50 is failsafe. If electrical power is either directed off by the cooling system 11, or if electrical power fails, the valve 70 is maintained in an open position by centrifugal force, thereby allowing viscous fluid to be maintained in the working chamber 64 and thereby limiting the rotational speed of the water pump shaft 62 as described above. This also prevents pump cavitation.

While the best modes for carrying out the present invention have been described in detail herein, those familiar with the art to which this invention relates will recognize various alternate designs and embodiments for practicing the invention as defined by the following claims. For example, the location of the pulley 54 relative to the clutch 60 and water pump 34 could be changed, in that the pulley 54 could be between the clutch 60 and the water pump 34 and work in a similar manner. Further, the valve 70 could be moved electronically from an open position to a closed position in a wide variety of methods to control movement of fluid from the fluid reservoir 66 to the fluid working area 64. All of these embodiments and variations that come within the scope and meaning of the present claims are included within the scope of the present invention.

What is claimed is:

1. An electronically-controlled viscous coupling having a fluid chamber coupled to a water pump for controlling the coolant flow rate through the water pump, the electronically-controlled viscous coupling comprising:

a pulley adapted to a belt drive;

a clutch fluidically coupled with said pulley;

a water pump drive shaft coupled with said clutch, said water pump drive shaft extending into said water pump and having a plurality of impellers;

a valve plate disposed to separate the fluid chamber into a fluid working chamber and a fluid reservoir chamber, said valve plate having at least one valve capable of movement between an open position, a semi-open position, and a closed position, said valve being normally biased in said open position, wherein said open position and said semi-open position allows movement of a viscous fluid from said fluid reservoir chamber to said fluid working chamber through a fill port, wherein said viscous fluid within said fluid working chamber is sheared between said pulley and said clutch to produce rotational movement of said water pump drive shaft and said plurality of impellers, thereby producing coolant flow through the water pump; and a stationary coil, said stationary coil capable of being electrical stimulated to produce a magnetic flux, said magnetic flux capable of moving said at least one valve from said open position to said closed position, wherein said closed position prevents the movement of viscous fluid from said fluid reservoir chamber to said fluid working chamber through said fill port.

2. The electronically-controlled viscous coupling of claim 1, wherein the amount of rotational movement of said water pump shaft is a function of the amount of shear of said viscous fluid between said pulley and said clutch.

3. The electronically-controlled viscous coupling of claim 2, wherein said amount of shear of said viscous fluid is a function of the amount of said viscous fluid in said fluid working chamber and the speed of rotation of said belt drive.

4. The electronically-controlled viscous coupling of claim 3, wherein said amount of viscous fluid in said fluid working chamber is a function of an amount of electrical impulse on said stationary coil.

5. The electronically-controlled viscous pump of claim 4, wherein said amount of electrical impulse is a function of engine speed and engine temperature.

6. The electronically-controlled viscous coupling of claim 1, wherein said clutch has a pump, said pump capable of removing said viscous fluid from said fluid working chamber to said fluid reservoir chamber.

7. A method for electronically controlling water pump speed to prevent water pump cavitation, the method comprising the step of:

coupling an electronically-controlled viscous coupling to the water pump, said electronically-controlled viscous coupling comprising a pulley coupled to a belt drive; a clutch fluidically coupled with said pulley; a water pump drive shaft coupled with said clutch and extending into the water pump; a plurality of impellers coupled to said water pump drive shaft contained within the water pump; a stationary coil; and a valve plate disposed to separate the fluid chamber into a fluid working chamber and a fluid reservoir chamber having a fill port and at least one valve capable of movement between an open position, a semi-open position, and a closed position, wherein said at least one valve is normally biased in an open position in the absence of electrical excitation of said electronically-controlled viscous coupling; and preventing the introduction of said viscous fluid to said fluid working chamber when a first set of operating conditions is present, thereby preventing said viscous fluid from being sheared between said pulley and said clutch to produce torque to rotate said water pump shaft to produce coolant flow within the water pump.

8. The method of claim 7, wherein the step of preventing the introduction of said viscous fluid to said fluid working chamber when a first set of operating conditions is present comprises the step of sealing said fill port by moving said at least one valve from said open position or said semi-open position to said closed position when a first set of operating conditions is present, thereby preventing movement of viscous fluid from said fluid reservoir chamber to said fluid working area.

9. The method of claim 8 wherein the step of sealing said fill port when a first set of operating conditions is present comprises the step of exciting said stationary coil to produce a magnetic flux when a first set of operating conditions is present, said magnetic flux capable of inducing movement of said at least one valve from said open position or said semi-open position to said closed position, wherein said closed position prevents the movement of viscous fluid from said fluid reservoir chamber to said fluid working chamber through said fill port.

10. The method of claim 7, wherein said first set of operating conditions is a function of engine speed and engine temperature.

11. A method for improving fuel economy and reducing emissions, the method comprising the step of:

coupling a water pump to an electronically controlled viscous coupling, said electronically-controlled viscous coupling comprising:

a pulley adapted to a belt drive;

a clutch fluidically coupled with said pulley;

a water pump drive shaft coupled with said clutch, said water pump drive shaft extending into said water pump and having a plurality of impellers;

a valve plate disposed to separate the fluid chamber into a fluid working chamber and a fluid reservoir chamber, said valve plate having at least one valve capable of movement between an open position, a semi-open position, and a closed position, said valve being normally biased in said open position, wherein said open position and said semi-open position allows movement of a viscous fluid from said fluid reservoir chamber to said fluid working chamber through a fill port, wherein said viscous fluid within said fluid working chamber is sheared between said pulley and said clutch to produce rotational movement of said water pump drive shaft and said plurality of impellers, thereby producing coolant flow through the water pump; and a stationary coil, said stationary coil capable of being electrical stimulated to produce a magnetic flux, said magnetic flux capable of moving said at least one valve from said open position to said closed position, wherein said closed position prevents the movement of viscous fluid from said fluid reservoir chamber to said fluid working chamber through said fill port; and electronically controlling an amount of electrical current being introduced to said stationary coil as a function of a first set of engine operating conditions.

12. The method of claim 11, wherein the step of electronically controlling an amount of electrical current being introduced to said stationary coil as a function of a first set of engine operating conditions comprises electronically controlling an amount of electrical current being introduced to said stationary coil as a function of engine temperature and engine speed.

13. The method of claim 11, wherein the step of electronically controlling an amount of electrical current being introduced to said stationary coil as a function of a first set of engine operating conditions comprises selectively increasing or decreasing an amount of a viscous fluid in a fluid working chamber of an electronically-controlled viscous coupling by controlling an amount of electrical current being introduced to said stationary coil as a function of a first set of engine operating conditions, wherein said viscous fluid is sheared in said fluid working chamber between a rotating pulley and a clutch of said electronically-controlled viscous coupling to produce torque between said rotating pulley and said clutch, thereby causing rotation of said clutch and rotation of a water pump shaft coupled to said clutch, said rotating water pump shaft causing movement of engine coolant through said water pump by rotating a plurality of impellers coupled to said water pump shaft.

* * * * *